United States Patent [19]

Kern

[11] 4,031,730

[45] June 28, 1977

[54] TAMPERPROOF LOCK AND METHOD

[76] Inventor: Michael F. Kern, 4304 Janwood, Copley, Ohio 44321

[22] Filed: Feb. 4, 1976

[21] Appl. No.: 655,096

[52] U.S. Cl. ..... 70/419; 70/423; 70/455

[51] Int. Cl.[2] ..... E05B 17/14

[58] Field of Search ..... 70/416, 423, 447, 419, 70/406, 395, 379 R, 431

[56] References Cited

UNITED STATES PATENTS

| | | | |
|---|---|---|---|
| 2,179,947 | 11/1939 | Miller | 70/364 A |
| 2,491,337 | 12/1949 | Segal | 70/419 |
| 3,267,707 | 8/1966 | Adams | 70/423 |

*Primary Examiner*—Paul R. Gilliam
*Assistant Examiner*—Kenneth J. Dorner
*Attorney, Agent, or Firm*—Hamilton, Renner & Kenner

[57] ABSTRACT

An apparatus is disclosed for preventing tampering with a locking mechanism, such as the conventional cylinder lock, which has a keyway therein and is normally rotatable when a key is in the keyway. A locking arm normally holds the locking mechanism to prevent rotation thereof even when the key or a foreign device is in the keyway. In order to release the locking arm and rotate the locking mechanism, access to the keyway is first blocked thereby prohibiting someone from attempting to pick the lock with a foreign device.

12 Claims, 4 Drawing Figures

TAMPERPROOF LOCK AND METHOD

BACKGROUND OF THE INVENTION

This invention relates to an apparatus designed to prevent the unauthorized opening of conventional locks such as cylinder lock. More specifically, the invention will prohibit one from attempting to pick a lock with a foreign device because even if the internal mechanism of the lock could be set, it will not rotate until acess to the keyway is blocked. With such access blocked, the picking of the lock cannot be accomplished.

Conventional locks, such as the cylinder lock found on many vending machines, pay telephones, amusement devices and the like, are quite susceptible to being picked. Usually the interal mechanisms of these types of locks include a plurality of spring loaded tumblers which are properly set by the key designed therefor. Once set, of course, the lock can be rotated and the compartment under lock opened. With such a mechanism it is not too difficult to utilize a paper clip, hair pin or the like and maneuver the same until all the tumblers are set to thereby open the lock. Of course, such maneuvering requires continual access to the keyway.

To date no device of which I am aware utilizes a double lock system to prevent the rotation of the cylinder lock even after the lock is set, either by key or foreign device. The second lock, holding the cylinder lock and preventing rotation thereof, is released only after access to the keyway is blocked prohibiting one from maintaining the cylinder lock set with a foreign device.

SUMMARY OF THE INVENTION

It is therefore a primary object of the present invention to provide a device which will render a conventional locking mechanism tamperproof.

It is another object of the present invention to provide a device, as above, which cannot be picked through access to the keyway by use of a foreign implement.

It is a further object of the present invention to provide a device, as above, which prevents rotation and opening of the locking mechanism even if the locking mechanism is set to rotate.

It is yet another object of the present invention to provide a device, as above, wherein access to the keyway is blocked before the locking mechansim may be rotated.

These and other objects of the present invention, which will become apparent from the description to follow, are accomplished by the means hereinafter described and claimed.

In general, the apparatus which prevents tampering with a locking mechanism of the type which has an accessible keyway therein and being normally rotatable with a key in the keyway includes a device which normally holds or locks the locking mechanism to, prevent rotation thereof even when the key is in the keyway. The apparatus further includes an actuating means which sequentially blocks access to the keyway, releases the device normally holding the locking mechanism and then rotates the locking mechanism to effect the opening of that which is being protected by the lock.

DESCRIPTION OF THE PREFERRED EMBODIMENT

Figure 1:
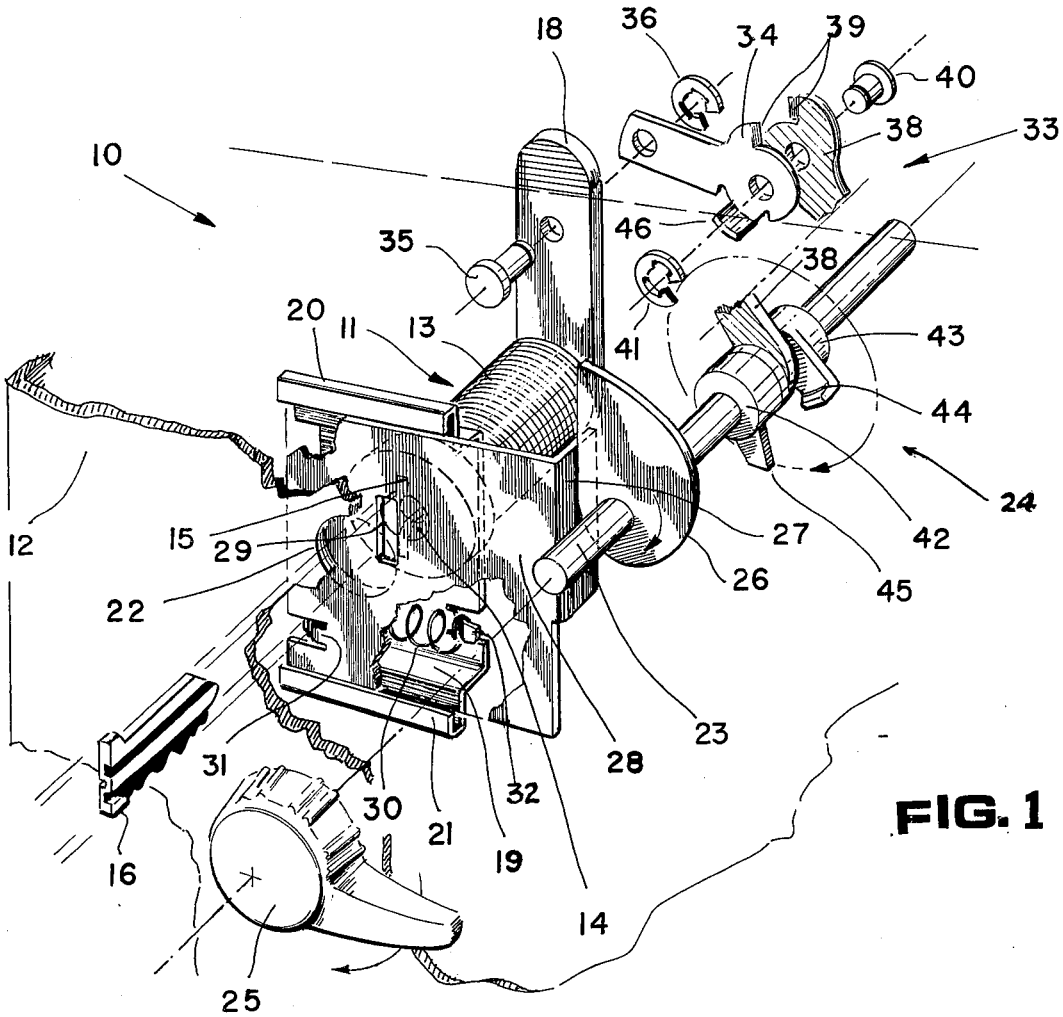
FIG. 1 is an exploded prospective view of the device according to the present invention with portions thereof being broken away.

The device according to the present invention is indicated generally by the numeral 10 in FIG. 1 working in conjuction with a conventional cylinder locking mechanism, generally indicated by the numeral 11, to lock a box 12 which could contain money or other valuables therein. As is well known in the art, cylinder lock 11 includes a non-rotatable outer casing 13 and an inner plug 14 having a keyway 15 therein to receive a key 16. Upon insertion of the key, tumblers (not shown) are set such that plug 14 is normally rotatable. While a cylinder lock is shown herein by way of example, it is to be understood that the present invention could be utilized with any rotatable locking mechanism having a keyway therein.

Figure 2:
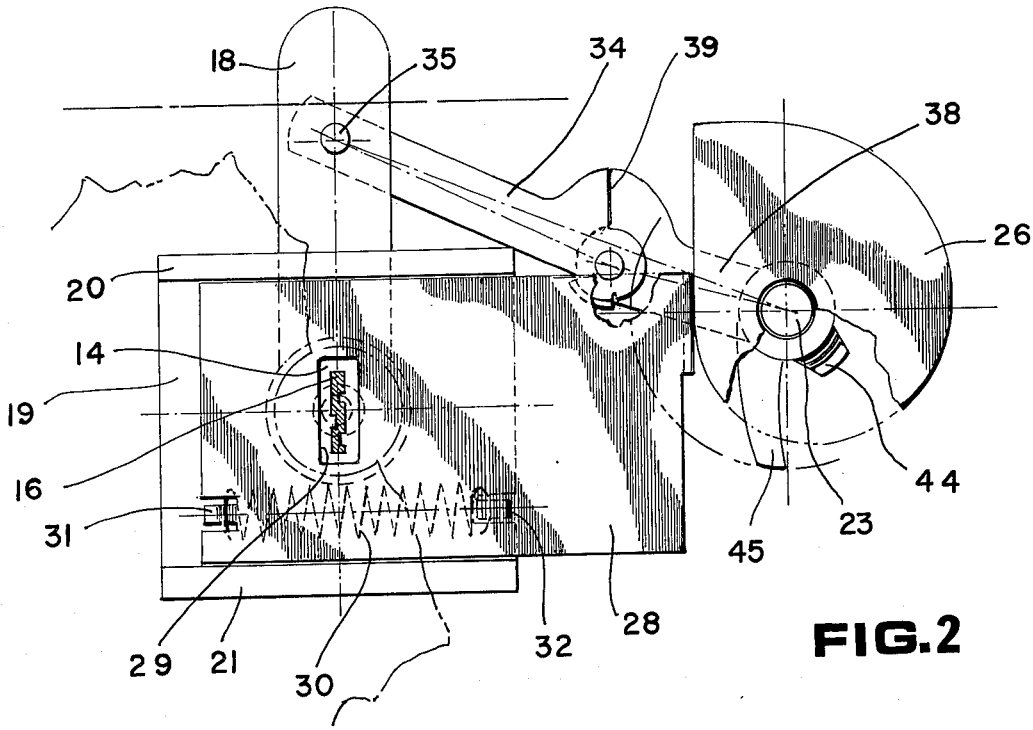
FIG. 2 is an elevational view having portions thereof broken away and depicting the device according to the present invention holding the locking mechanism in a closed and locked position even though the key is in the keyway.

Affixed to the end of plug 14 opposite keyway 15 and rotatable therewith is a lock bar 18 which is generally vertical in the locked position as shown in FIG. 2. In this position the top of bar 18 extends to a point higher than the top of box 12 so that it might abut or interfere with some fixed member (not shown) to prevent the box from being removed, that is, unlocked. When eventually rotated to the unlocked position shown in FIG. 4, bar 18 is below the top of box 12 so that there will be no interference to the removal of the box.

Locking mechanism 11 is affixed to a mounting plate 19 having upper and lower flange ends 20 and 21, respectively, which are affixed to the inside of box 12 as by welding or other suitable attachment. The end of the locking mechanism having keyway 15 extends through mounting plate 19 slightly so as to permit access to keyway 15 through a circular port 22 in the front face of box 12. Thus, the front edge of keyway 15 is recessed, that is, spaced slightly from the front face of box 12.

A rotatable shaft 23 is supported from the inside of the back plate of box 12 and extends through the front face thereof to carry or operate the components of an actuation assembly indicated generally by the numeral 24. A handle 25 is mounted on shaft 23 exteriorly of box 12 to permit facile rotation of the shaft. Mounted on shaft 23 interiorly of box 12 is a cam plate 26 which rides against a rearwardly extending flange 27 of a keyway blocking plate 28. Blocking plate 28 is slidable horizontally in the space defined vertically by flange ends 20 and 21 of mounting plate 19 and on the sides by the front face of box 12 and the front edge of keyway 15. Thus, blocking plate 28 is normally positioned between port 22 in box 12 and keyway 15 and is slidable therebetween. Blocking plate 28 has a slot 29 therein so that when the locking mechanism is locked, as shown in FIG. 2, access to keyway 15 may be had therethrough. A coil spring 30 is mounted between a clip 31 formed in blocking plate 28 and a clip 32 formed in mounting plate 19 to maintain cam plate 26 in contact with flange 27. A clockwise rotation of shaft 23 by the external handle 25 moves blocking plate 28 to the left, from the FIG. 2 to the FIG. 4 position, which moves the slot 29 away from in front of keyway 15 to thus block access to the keyway from the outside.

In order to prevent rotation of the plug 14 of the locking mechanism even when the tumblers are set, by the presence of either a properly designed key or some foreign device in the keyway, a locking or holding assembly, indicated generally by the numeral 33, is provided. Holding assembly 33 includes a duo-arm pivotal knee lock joint consisting of a first arm 34 the outer end of which is affixed, as by pin 35 and springable C-clip 36, to lock bar 18. The inner end of arm 34 is configured to mate with the inner end of a second arm 38 to form the knee lock 39, the inner ends of arms 34 and 38 being held together by pin 40 and springable C-clip 41. The outer end of second arm 38 is slidably received around shaft 23 and held in place longitudinally along shaft 23 by collars 42 and 43 affixed to shaft 23 by set screws or the like.

Figure 3:
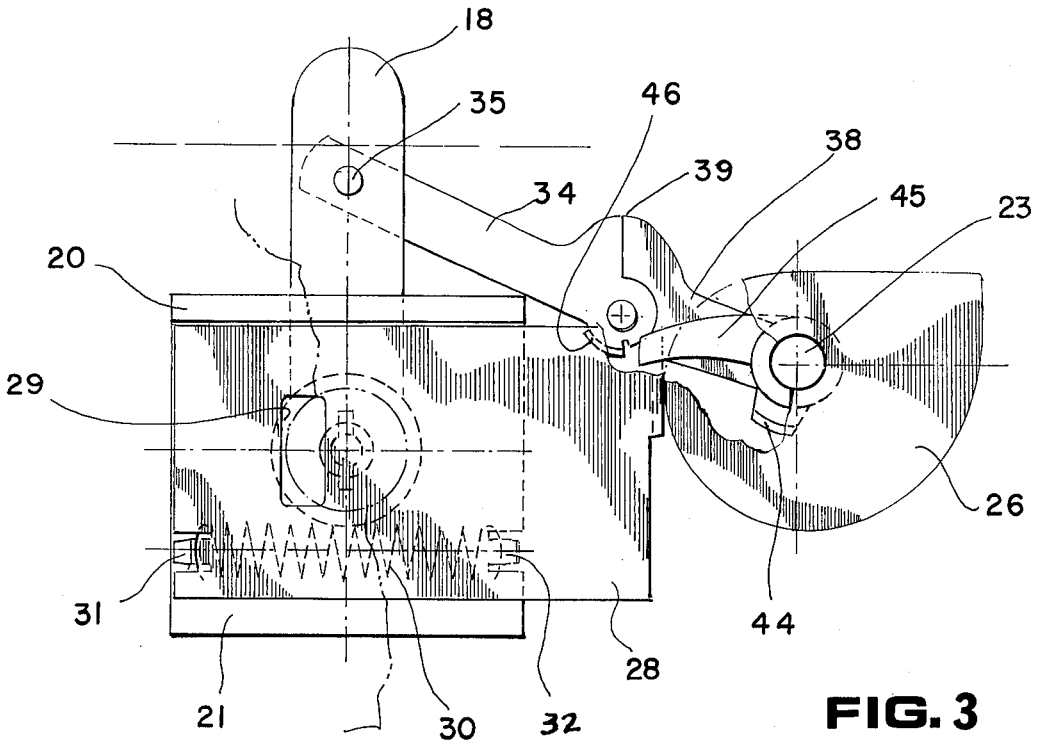
FIG. 3 is an elevational view having portions thereof broken away and sequentially following FIG. 2 in the operation of the device according to the present invention showing access to the keyway blocked prior to release of the locking mechanism.
Figure 4:
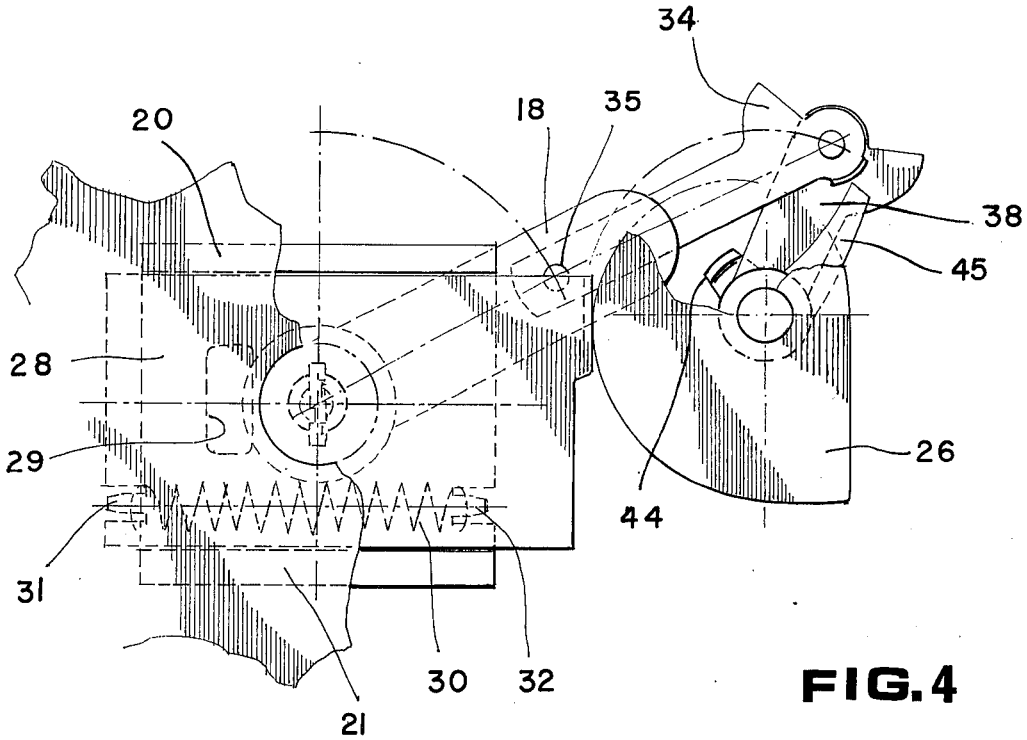
FIG. 4 is an elevational view having portions thereof broken away and sequentially following FIG. 3 in the operation of the device according to the present invention showing access to the keyway blocked and the locking mechanism released and rotated.

As part of the activation assembly 24, collar 43 has an unlocking latch 44 formed thereon which, as best seen in FIGS. 3 and 4 and as will hereinafter be described in conjunction with the operation of the device, contacts arm 38 upon rotation of shaft 23 to unlock the knee lock 39. Collar 42 has a resetting latch 45 thereon which as will hereinafter be described, contacts projection 46 extending from arm 34 at knee lock 39 to relock the same when shaft 23 is rotated in the counterclockwise direction.

In operation, when box 12 is locked the position of the elements will be as shown in FIG. 2. The locking mechanism 11 and the arm 18 attached thereto are prohibited from rotating by knee lock 39 even when the tumblers of the lock are set by a key or foreign device. Thus, if one were to attempt to pick the lock with a paper clip or the like, even if he were able to set the tumblers, arm 18 will not rotate. However, with the tumblers set, rotation of handle 25 in the clockwise direction to a point shown in FIG. 3 activates the actuation assembly 24 by first moving blocking plate 28 to the left moving slot 29 away from alignment with keyway 15 thus blocking access to the keyway. However, if one is to pick a lock with a foreign device, he must have continual access to the keyway to maintain the tumblers in their set position. But without moving the blocking plate over the keyway the locking or holding assembly 33 will not be unlocked because just after the blocking plate closes off the keyway, and only if the tumblers are set, latch 44 begins to contact arm 38 (FIG. 3) to lift the same to the FIG. 4 position and break the knee lock. After the knee lock is broken, arm 34 pulls bar 18 to FIG. 4 position to open box 12. If the tumblers are not set, continued rotation of shaft 23 past the FIG. 3 position will begin to break the knee lock but further rotation to the FIG. 4 position will not be possible because bar 18 will be locked in place.

The authorized entry into box 12 is thus a simple matter. First key 16 is inserted into the keyway to set the tumblers. Key 16 is shown as being handleless so that the space between the locking mechanism and the plane of the blocking plate can be minimal. Of course, if desired, a normally configured key could be utilized with more space being left between the locking mechanism and the blocking plate and a slightly larger slot 29 being formed in the blocking plate. With the key in the keyway, handle 25 and shaft 23 can be rotated clockwise from the FIG. 2 to the FIG. 3 position. It should be noted that because of the configuration of cam plate 26, access to the keyway is blocked before latch 44 contacts bar 38 to begin unlocking knee lock 39. As also shown in FIG. 3, latch 45 is of such a length as to clear projection 46 during the clockwise opening movement. Continued rotation of shaft 23 to the FIG. 4 position opens the knee lock and pulls bar 18 to open box 12. Upon the reverse counterclockwise rotation of shaft 23, projection 46 is now in a position to be contacted by latch 45 which will relock the knee lock, and return bar 18 to its vertical position. Continued rotation back to the FIG. 2 position unblocks the keyway because of the bias of spring 30 and permits one to remove the key. If the handleless key 16 is utilized, a conventional needle nosed implement can remove the same. If a conventional full-handled key were to be utilized, it would only be necessary to further recess the locking mechanism from the blocking plate and provide a slightly larger slot in the blocking plate.

It should therefore be evident that because of the duo-locking system employed herein, access to the keyway necessary to pick the lock cannot be maintained and thus the objects of the invention are accomplished thereby substantially improving the art.

I claim:

1. Apparatus to prevent tampering with a locking mechanism having an accessible keyway therein and normally rotatable when a key is in the keyway comprising, means normally holding the locking mechanism to prevent rotation thereof even when the key is in the keyway; blocking plate means having a slot therein normally aligned with the keyway; cam means to move said blocking plate means so that said slot and keyway are misaligned; means to release said means normally holding the locking mechanism; and movable means carrying said means normally holding the locking mechanism, said cam means, and said means to release so that movement of said movable means sequentially moves said blocking plate means to block access to the keyway, operates said means to release, and rotates said locking mechanism.

2. Apparatus according to claim 1 further comprising biasing means to maintain said blocking plate means in contact with said cam means.

3. Apparatus according to claim 1 further comprising bar means affixed to the locking mechanism and normally rotatable therewith.

4. Apparatus according to claim 3 wherein said means normally holding the locking mechanism includes first and second arms forming a lock joint therebetween.

5. Apparatus according to claim 4 wherein said movable means includes shaft means carrying said second arm, said first arm being affixed to said bar means.

6. Apparatus according to claim 1 wherein said movable means include shaft means.

7. Apparatus according to claim 6 further comprising means carried by said shaft means to reset said means normally holding the locking mechanism.

8. Apparatus according to claim 6 wherein said means normally holding the locking mechanism includes first and second arms forming a lock joint therebetween.

9. Apparatus according to claim 8 wherein said means to release unlocks said lock joint by contacting said second arm.

10. Apparatus according to claim 9 further comprising a projection extending from said joint lock, and means carried by said shaft means to contact said projection to reset said lock joint.

11. Apparatus according to claim 1 wherein said movable means includes shaft means being rotatable to operate said blocking plate means, said means to release and the locking mechanism.

12. Apparatus according to claim 11 wherein said means to release includes first latch means carried by said shaft means; and further comprising second latch means carried by said shaft means; initial rotation of said shaft means moving said blocking plate means to misalign said slot and said keyway, further rotation of said shaft means causing said first latch means to release said means normally holding the locking mechanism and then rotating the locking mechanism, with reverse rotation of said shaft means causing said second latch means to reset said means normally holding the locking mechanism to again hold the locking mechanism.

* * * * *